US007537497B2

(12) United States Patent
Tyler

(10) Patent No.: US 7,537,497 B2
(45) Date of Patent: May 26, 2009

(54) MULTI-PIECE ELECTRICAL RECEPTACLE TERMINAL

(75) Inventor: Adam P. Tyler, Rochester Hills, MI (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 11/508,803

(22) Filed: Aug. 22, 2006

(65) Prior Publication Data

US 2007/0072494 A1 Mar. 29, 2007

Related U.S. Application Data

(60) Provisional application No. 60/720,714, filed on Sep. 26, 2005.

(51) Int. Cl.
*H01R 13/187* (2006.01)

(52) U.S. Cl. ..... 439/843; 439/852

(58) Field of Classification Search ..... 439/843, 439/851–852, 845–846
See application file for complete search history.

(56) References Cited

U.S. PATENT DOCUMENTS 4,342,498 A * 8/1982 Patton et al. ..... 439/839
4,540,233 A * 9/1985 Saijo et al. ..... 439/834
4,880,401 A * 11/1989 Shima et al. ..... 439/746
5,217,382 A * 6/1993 Sparks ..... 439/161
5,226,842 A * 7/1993 Endo et al. ..... 439/843
5,281,178 A * 1/1994 Biscorner ..... 439/845
5,601,458 A 2/1997 Ohsumi et al. ..... 439/852
5,607,328 A * 3/1997 Joly ..... 439/852
5,800,220 A 9/1998 Feeny et al. ..... 439/849
6,050,862 A * 4/2000 Ishii ..... 439/843
6,056,604 A 5/2000 Roy et al. ..... 439/845
6,139,376 A * 10/2000 Ooya et al. ..... 439/843
6,247,975 B1 6/2001 Cue ..... 439/845
6,416,366 B2 7/2002 Endo et al. ..... 439/851
6,464,547 B2 10/2002 Ketelsleger ..... 439/851
6,475,040 B1 * 11/2002 Myer et al. ..... 439/852
6,547,608 B2 4/2003 Sato et al. ..... 439/852
6,790,100 B2 9/2004 Nankou et al. ..... 439/851

* cited by examiner

*Primary Examiner*—Truc T Nguyen
*Assistant Examiner*—Xuong M Chung-Trans
(74) *Attorney, Agent, or Firm*—Harrington & Smith, PC

(57) ABSTRACT

A multi-piece electrical receptacle terminal including a frame with a receptacle section adapted to receive a male contact; and a spring movably captured in the receptacle section. The spring includes a front end and a contact section spaced from the front end for contacting the male contact when the male contact is inserted into the receptacle section. The frame includes inward projections capturing the front end of the spring at the inward projections. The receptacle section includes an interior facing frame contact surface for contacting the male contact when the male contact is inserted into the receptacle section. The frame contact surface includes at least one inward projection which form a plurality of angled contact areas. At least one of the contact areas is angled relative to an insertion path of the male contact into the receptacle section.

25 Claims, 8 Drawing Sheets

MULTI-PIECE ELECTRICAL RECEPTACLE TERMINAL

CROSS REFERENCE TO RELATED APPLICATION

This application claims the benefit under 35 U.S.C. §119 (e) of provisional patent application No. 60/720,714 filed Sep. 26, 2005 which is hereby incorporated by reference in its entirety.

BACKGROUND OF THE INVENTION

1. Field of the Invention

The invention relates to an electrical connector and, more particularly, to a multi-piece electrical receptacle terminal.

2. Brief Description of Prior Developments

U.S. Pat. Nos. 6,247,975 and 6,056,604 disclose multi-piece electrical receptacle terminals. Springs are provided to mechanically and electrically connect a male contact or blade terminal in the receptacle terminals. There are different size (width) blade terminals including a 1.2 mm width blade and a 0.64 mm width blade. In the past, electrical receptacle terminals were designed specifically for the intended size blade terminal such that the spring would not rotate or twist when used with a smaller size blade terminal. Rotation or twisting of the spring could result in inadequate electrical contact between the blade terminal and the receptacle terminal.

There is a desire to provide an electrical receptacle terminal which is adapted to be used with multiple sizes of blade terminals without significant risk of the spring twisting or rotating. Providing a single size electrical receptacle terminal for multiple size blade terminals can reduce the costs associated with manufacturing electrical receptacle terminals.

SUMMARY OF THE INVENTION

In accordance with one aspect of the invention, a multi-piece electrical receptacle terminal is provided including a frame with a receptacle section adapted to receive a male contact; and a spring movably captured in the receptacle section. The spring includes a front end and a contact section spaced from the front end for contacting the male contact when the male contact is inserted into the receptacle section. The frame includes inward projections capturing the front end of the spring at the inward projections.

In accordance with another aspect of the invention, a multi-piece electrical receptacle terminal is provided comprising a frame with a receptacle section adapted to receive a male contact; and a spring movably located in the receptacle section. The spring comprises a front end with two laterally outward projections, and a contact section for contacting the male contact when the male contact is inserted into the receptacle section. The frame captures the two laterally outward projections of the front end of the spring at a front end of the frame.

In accordance with another aspect of the invention, a multi-piece electrical receptacle terminal is provided comprising a frame with a receptacle section adapted to receive a male contact, and a spring. The receptacle section comprises an interior facing frame contact surface for contacting the male contact when the male contact is inserted into the receptacle section. The frame contact surface comprises at least one inward projection which form a plurality of angled contact areas. At least one of the contact areas is angled relative to an insertion path of the male contact into the receptacle section. The spring is movably captured in the receptacle section. The spring comprises a spring contact surface for contacting the male contact when the male contact is inserted into the receptacle section, wherein the spring contact surface is located opposite the frame contact surface.

In accordance with another aspect of the invention, a multi-piece electrical receptacle terminal is provided comprising a frame with a receptacle section adapted to receive a male contact, a spring movably captured in the receptacle section, and means for mechanically and electrically contacting the male contact when the male contact is inserted into the receptacle section. The means for mechanically and electrically contacting the male contact comprises a patterned inwardly projecting surface on the frame opposite a spring contact surface of the spring. The means for mechanically and electrically contacting the male contact is adapted to sandwich a portion of the male contact between the patterned surface and the spring contact surface.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
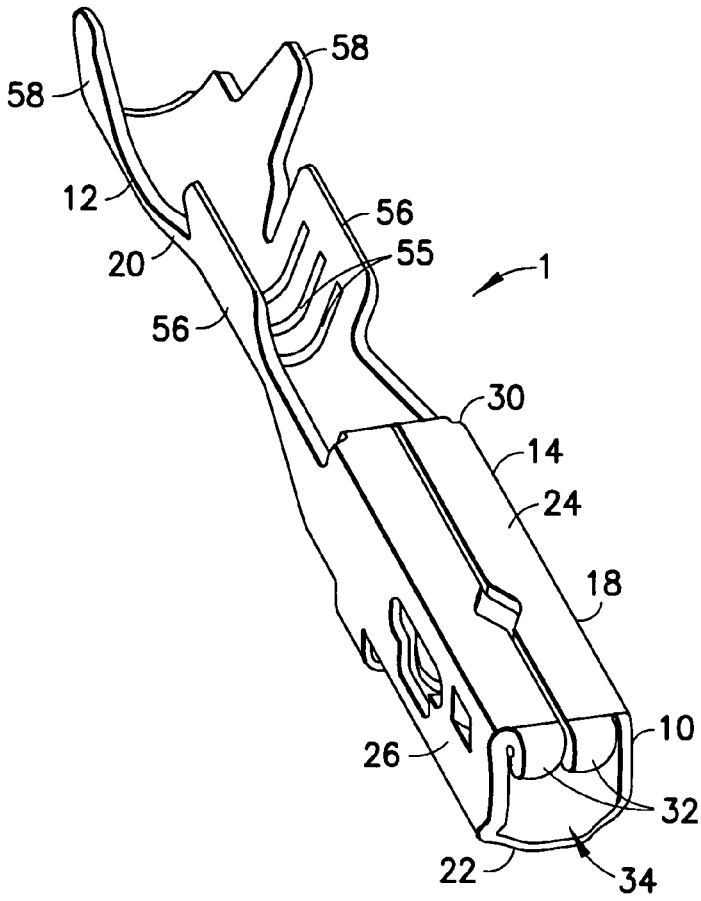
FIG. 1 is a perspective view of a receptacle terminal incorporating features of the invention.

Referring to FIG. 1, there is shown a perspective view of an electrical receptacle terminal or contact 1 incorporating features of the invention. Although the invention will be described with reference to the exemplary embodiment shown in the drawings, it should be understood that the invention can be embodied in many alternate forms of embodiments. In addition, any suitable size, shape or type of elements or materials could be used.

The electrical receptacle terminal 1 shown in FIG. 1 is generally adapted to be used with a male or blade terminal 201 (see FIG. 6) having a pin contact section 200 adapted to be removably inserted into the receptacle terminal 1. The male terminal 201 is mated to the electrical receptacle terminal 1 through the front end 10 of the receptacle terminal 1. The rear end 12 of the terminal 1 is adapted to connect the terminal 1 to a conductor (not shown). The terminal 1 is a multi-piece terminal. The terminal 1 generally comprises a terminal body or frame 14 and a spring 16 (see FIG. 2). The spring 16 is mounted to the terminal body 14. However, the receptacle terminal could comprise additional members.

Figure 2:
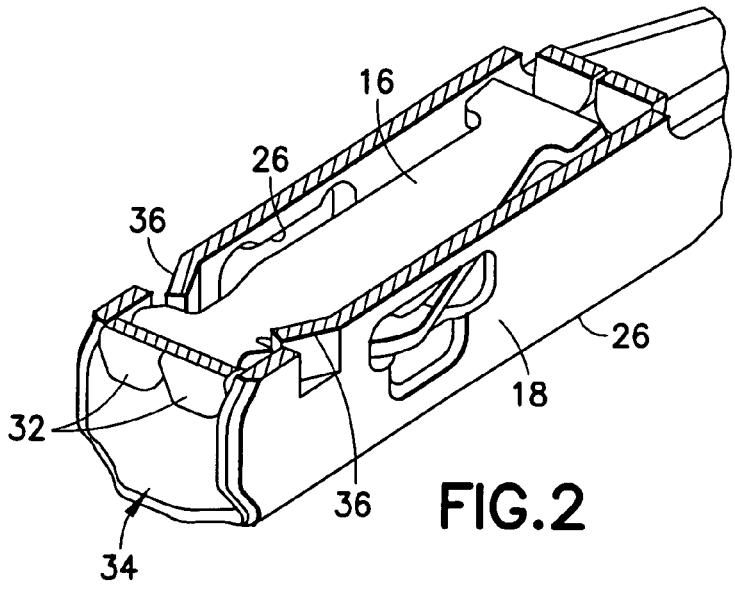
FIG. 2 is a partial cut-away perspective view of the terminal shown in FIG. 1.

Referring now to FIGS. 1 and 2, the terminal body 14 is preferably a one piece member made from sheet metal or other conductive material. The terminal body 14 has a front receptacle section 18 and a rear conductor connection section 20. The front receptacle section 18 is a shell adapted to admit therein the pin contact section 200 of the male terminal 201 (see FIG. 6). Preferably, the receptacle section 18 has a generally rectangular tubular shape. An open seam (i.e., opposing ends at the seam not directly fixed to each other) in the receptacle section 18 extends from the front 10 of the terminal 1 to the rear 30 of the receptacle section 18. In alternate embodiments, the receptacle section may have any other suitable tubular shape (such as a tube with a generally polygonal cross-section or a generally circular cross-section) to admit therein a pin contact of a male terminal and may be either seamless or have a closed seam.

The receptacle section 18 has a bottom side 22, a top side 24 and two lateral side walls 26 connecting the top side 24 to the bottom side 22. The top 24 and bottom sides 22 span between the side walls 26 of the receptacle section 18. In the preferred embodiment, the open seam is located in the top side 24 of the receptacle section 18 substantially bisecting the top side 24 into two sections. Alternatively, the open seam may be located in any other side of the receptacle section. The front end of the top side 24 comprises inward cantilevered projections 32. The projections 32 help to define the male contact entrance 34 at the front of the receptacle section.

Figure 3:
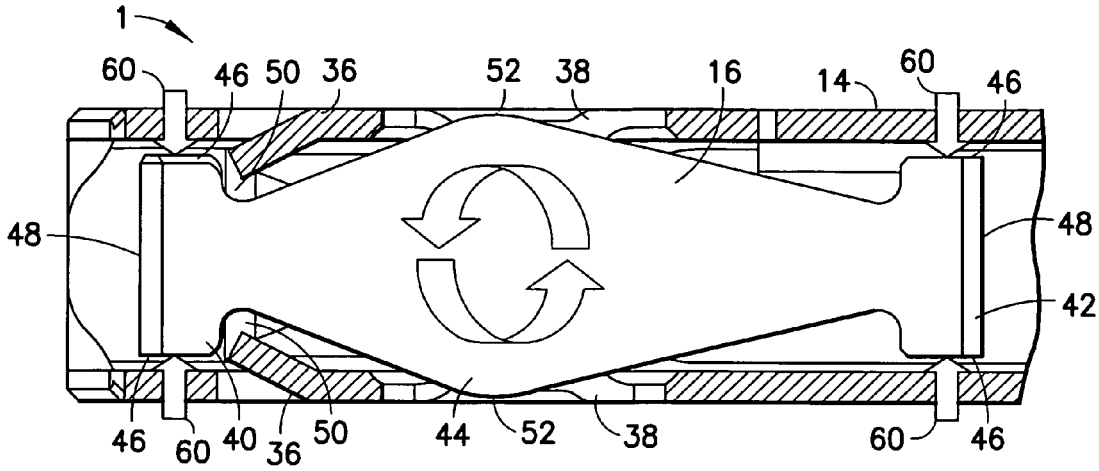
FIG. 3 is a cross sectional view of the terminal shown in FIGS. 1 and 2.

Referring also to FIGS. 2 and 3, the lateral side walls 26 each comprise inward cantilevered projections 36 proximate the front end of the receptacle section; spaced slightly rearwardly from the projections 32. This forms a pocket or receiving area at the underside of the top side 24 proximate the front of the receptacle section 18 between the projections 32 and the projections 36. The lateral side walls 26 each also comprise holes 38. The holes 38 are located behind the projections 36.

The rear conductor connection section 20 of the electrical receptacle terminal 1 has a general channel configuration adapted to receive a conductor (not shown) therein. The conductor connection section has an inner pair 56 and an outer pair 58 of crimp tabs. The inner pair of crimp tabs 56 are set closer together than the outer pair 58. The inner pair of crimp tabs 56 are provided with depressed surfaces 55 between the tabs as shown in FIG. 1. The terminal 1 is connected to the conductor by placing the conductor in the connection section 20 and crimping the inner pair 56 and outer pair 58 of crimp tabs. The inner pair 56 are crimped around the conducting core (not shown) and the outer pair 58 are crimped around the insulation (not shown) of the conductor.

Figure 4:
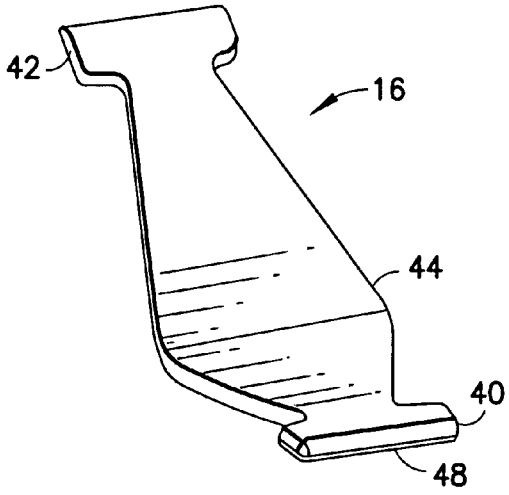
FIG. 4 is a top, front and left side perspective view of spring used in the terminal shown in FIGS. 2 and 3.
Figure 5:
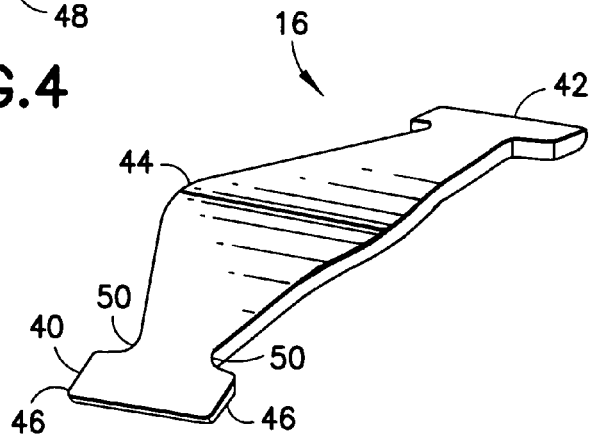
FIG. 5 is a bottom, front and right side perspective view of the spring shown in FIG. 4.

Referring also to FIGS. 4 and 5, the spring 16 is preferably stamped from sheet metal or other conductive material. The spring 16 has a general leaf spring configuration. When viewed from the top (see FIG. 3), the spring 16 has a shape comprising two hammer-head or T shaped opposite ends 40, 42 and a center section 44 which tapers in width towards the two ends 40, 42 from a relatively wide middle or center section 44. The center section 44 is bent or curved to form a bent or curved leaf spring shape. The ends 40, 42 are substantially the same. However, in alternate embodiments the ends could be different from each other. The ends 40, 42 each generally comprise two laterally outward projections 46 and a flat end edge 48. Pockets 50 are formed behind the projections 46 at the front end 40. The middle section 44 comprises two lateral tab sections 52 at its middle.

The spring 16 is mounted to the body 14 of the electrical receptacle terminal 1 within the receptacle section 18. The spring 16 is positioned and orientated within the receptacle section 18 to form an upper spring opposite the interior of the bottom side 22 of the receptacle section 18. The spring 16 is installed in the receptacle section 18 with the center section 44 down and the front and rear ends 40, 42 up. The tab sections 52 are movably located in the holes 38 of the side walls 26 of the receptacle section 18. Interaction between the tab sections 52 and the frame limit downward movement of the spring in the receptacle section. The tab sections 52 can move up and down in the holes 38 as the spring 16 is deflected by a male contact blade inserted into the receptacle section 18.

The front end 40 of the spring 16 is located between the projections 32, 36 with the projections 36 being received in the pockets 50. The edge 48 at the front end 40 can be located directly against the interior side of the top side 24. Because the front end 40 of the spring 16 is located between the projections 32, 36 the front end 40 is substantially prevented from moving longitudinally along the receptacle section 18. The center section 44 and rear end 42, on the other hand, are able to longitudinally move along the receptacle section.

Figure 6:
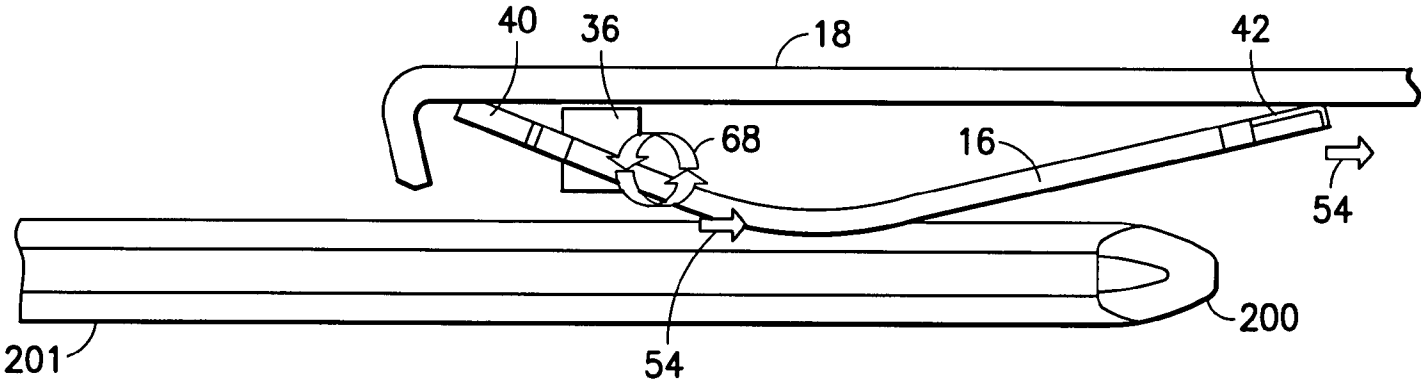
FIG. 6 is a partial cross sectional view illustrating connection of a male blade terminal to the receptacle terminal shown in FIG. 1.

Referring also to FIG. 6, the spring 16 provides a contact force for mating to the blade terminal 201. When the pin contact section 200 of the male or blade terminal 201 is inserted into the receptacle section 18, the front end 40 of the spring 16 is substantially prevented from moving rearward (although there might be some slight movement) because of the presence of the projections 36 behind the front end 40 (in the pockets 50). Thus, the center section 44 and rear end 42 are forced rearward (as indicated by arrows 54) as the middle section 44 is deflected upward by the pin contact section 200. The spring is designed to provide retention inside the terminal frame, and to provide resistance to rotation for a variety of blade widths without stress concentrating problems as further described below.

Figure 7:
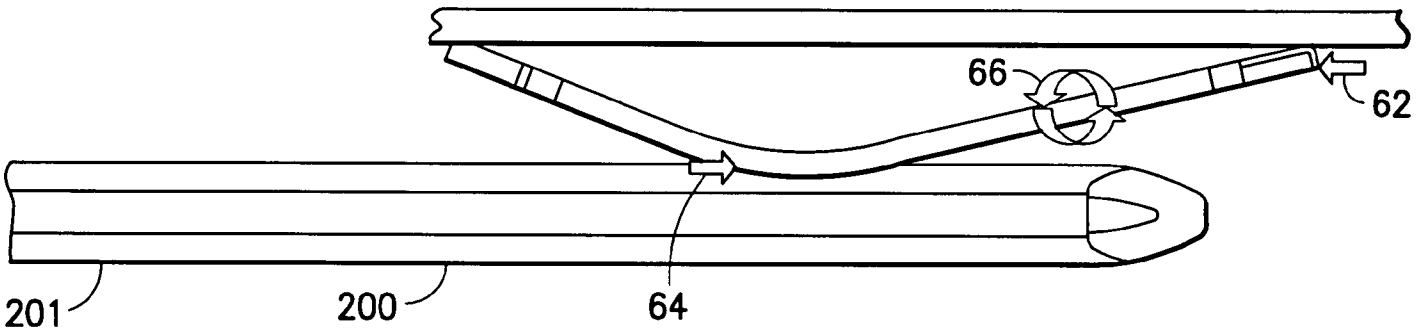
FIG.7 PRIOR ART
FIG. 7 is a partial cross sectional view similar to FIG. 6 illustrating connection of a conventional male blade terminal to a conventional receptacle terminal.

The shape of the spring as seen best in FIGS. 3-5 is tapered between the center and the opposite ends to evenly distribute stress from deflection along the length of the spring. There are substantially no stress concentrations. The double hammer design of the two ends 40, 42 prevents yaw rotation in the receptacle section 18 because of the close contact points at the outer ends of the ends 40, 42 to the side walls 26 as indicated by arrows 60 in FIG. 3. The front end of the spring 16 is retained by the projections 32, 36 at the front end of the frame. This provides temporary retention during terminal box forming and prevents the spring from binding due to friction/support force couple. As seen in FIG. 7, in the prior art spring binding 62 could occur because of friction at the rear end of the spring and the force couple created by the offset frictional insertion force 64 and the insertion reaction force 66. With the invention as seen in FIG. 6, on the other hand, because the frictional insertion force 54 is located behind the retention location of the front end 40 at the projections 36, the insertion reaction force 68 does not significantly contribute to spring binding. Because the risk of spring binding is reduced, it is easier to insert the blade into the terminal 1 without binding.

Figure 8:
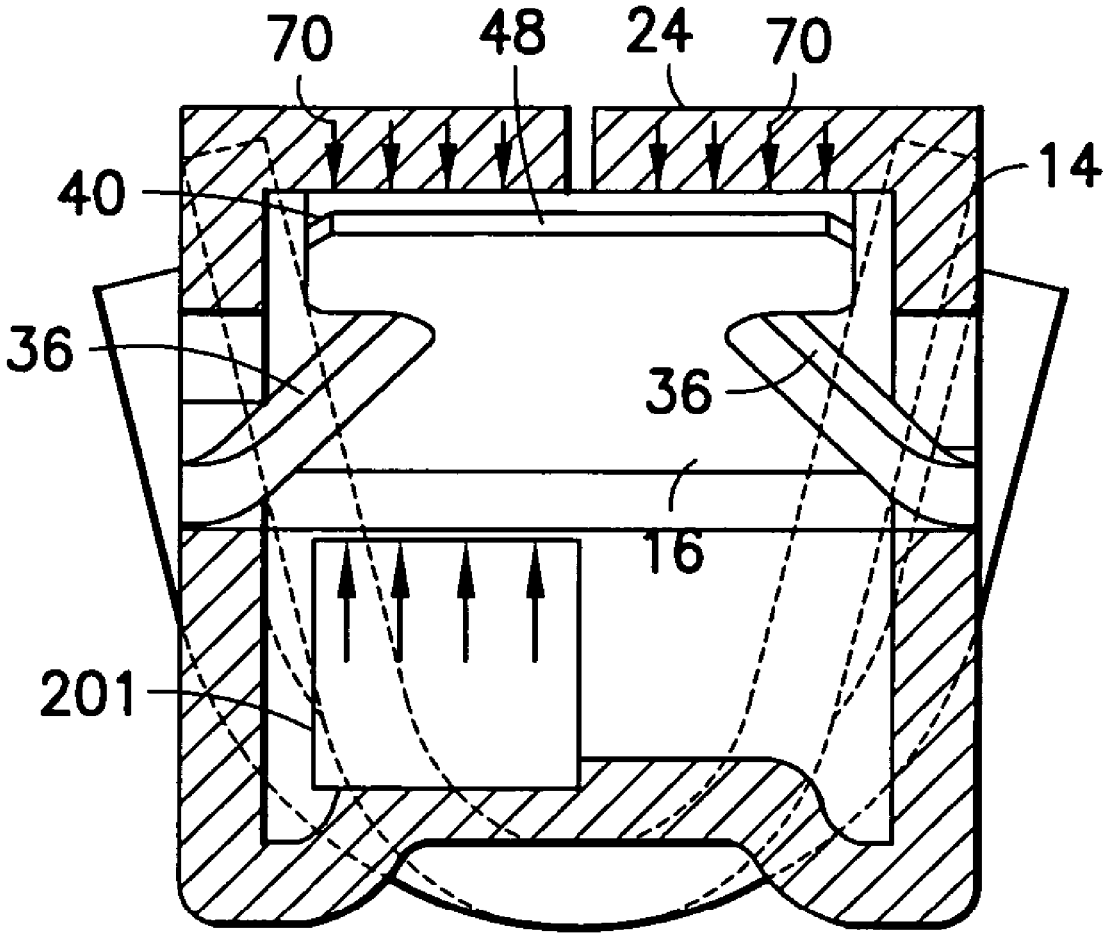
FIG. 8 is a partial cross sectional view illustrating contact between the end of the spring and the frame at the receptacle section of the receptacle terminal shown in FIG. 1.

The hammer-head or T shape design of the ends 40, 42 also resists rotation of the spring 16 when subjected to an eccentric load, such as a off-center blade insertion. For example, referring also to FIG. 8, even if the male contact blade 201 is substantially smaller in width than the width of the spring 16 and its center is offset relative to the center of the spring, because the end edge 48 of the front end 40 (and the rear end 42) spans almost the entire width of the interior of the receptacle section 18, and is flat such that it contacts substantially the entire interior side of the top wall 24 along its width, the forces 70 between the end edges 48 and the top wall 24 are substantially uniform along the width; thereby preventing rotation of the spring 16 relative to the longitudinal axis of the receptacle section.

Figure 9:
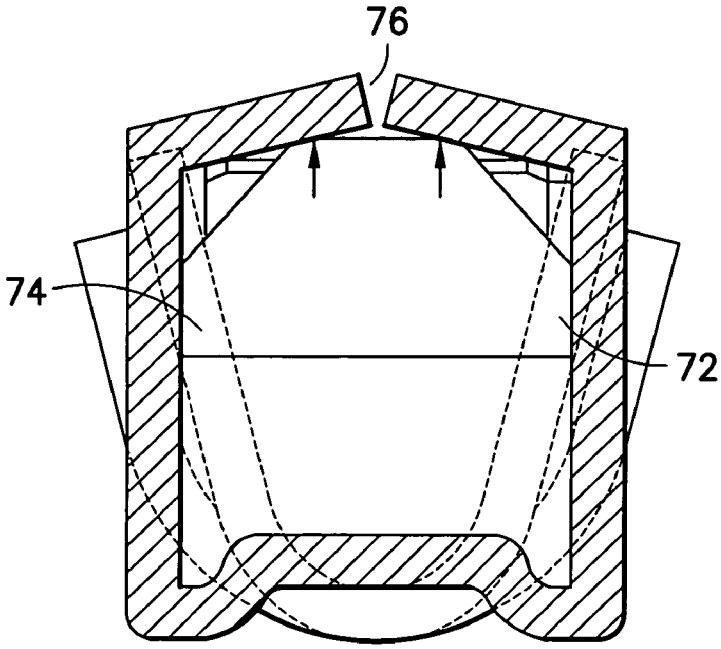
FIG.9 PRIOR ART
FIG. 9 is a partial cross sectional view showing opening of a seam in a receptacle terminal frame from contact with a spring in a conventional receptacle terminal.
Figure 10:
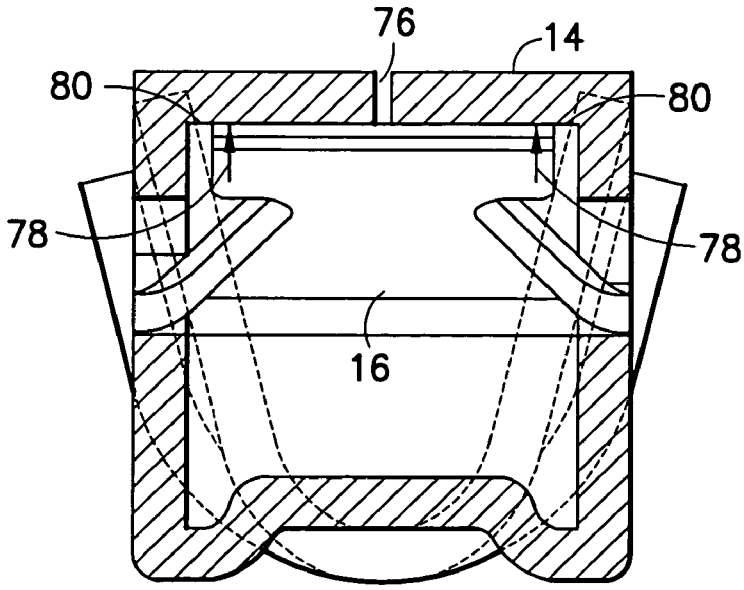
FIG. 10 is a partial cross sectional view similar to FIG. 9 showing contact between the spring and the frame to limit creation of moments and thereby help prevent opening of the seam.

Referring also to FIGS. 9 and 10, in the prior art the front and rear ends 72 of the springs 74 tended to open up the seam 76 in the frame as seen in FIG. 9. However, with the invention the front end of the spring comprises outer lateral edges in contact with a top side of the receptacle section proximate interior corners of the top side of the receptacle section. The rear end of the spring comprises outer lateral edges in contact with the top side of the receptacle section proximate the interior corners of the top side of the receptacle section. Thus, the spring ends 40, 42 direct the spring reaction force 78 more towards the terminal box corners 80, thus reducing moment arms which would otherwise cause the seam 76 to open.

Figure 11:
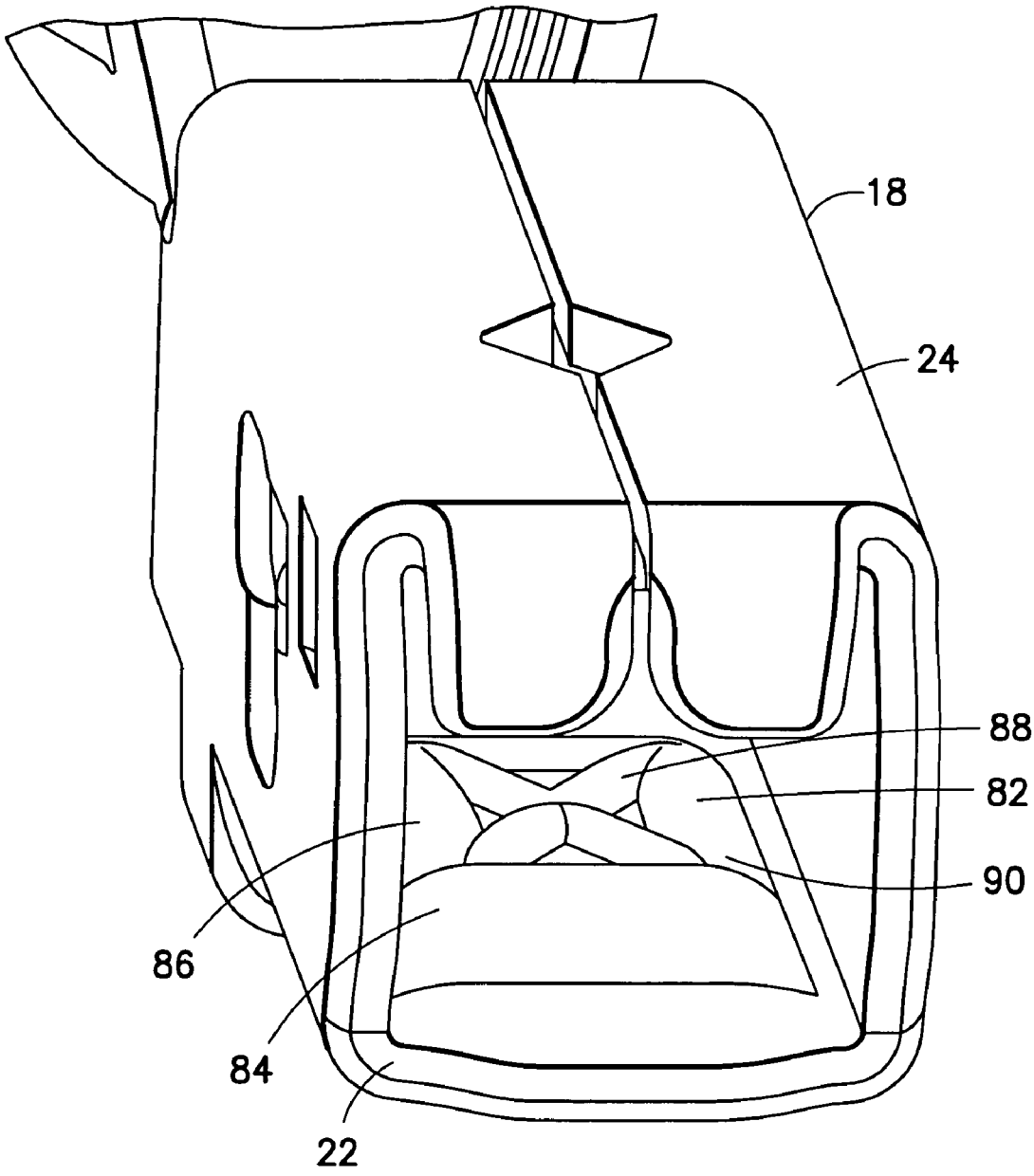
FIG. 11 is a partial perspective view of the terminal shown in FIG. 1.

Referring also to FIG. 11, the bottom side 22 of the receptacle section 18 includes an interior facing frame contact surface 82 for contacting the male contact 201 when the male contact is inserted into the receptacle section. The frame contact surface 82 comprises at least one inward projection 84 which forms a plurality of angled contact areas 86. In an alternate embodiment the projection 84 might not be provided. At least one of the contact areas 86 is angled relative to an insertion path of the male contact 201 into the receptacle section 18. In the embodiment shown, the at least one inward projection comprises a patterned surface. More specifically, the patterned surface comprises a general X shaped pattern 88 and a general box shaped pattern 90 around the general X shaped pattern. However, in alternate embodiments any suitable shape(s) could be provides including a ring or oval shape, a serpentine shape, parallel ribs, or combinations for example. In a preferred embodiment, the inward projection is stamped or coined into the bottom side 22.

Figure 12:
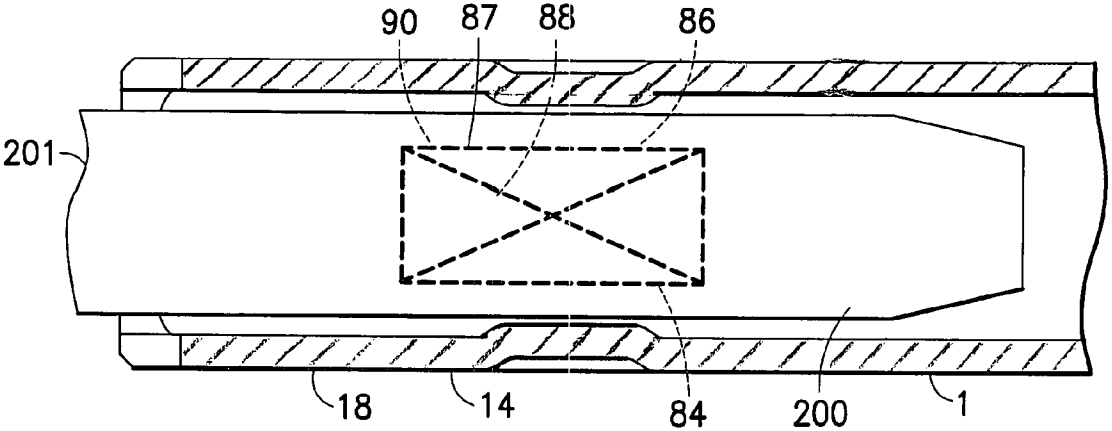
FIG. 12 is a cross sectional view of the receptacle terminal shown in FIG. 11 with one type of male or blade terminal inserted.
Figure 13:
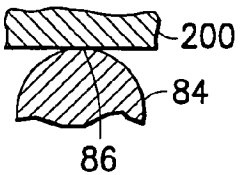
FIG. 13 is a partial cross sectional view showing contact between a flat surface of the male blade terminal and the contact area of the bottom side of the receptacle section of the receptacle terminal.

Referring also to FIG. 12, the pin contact section 200 of the blade terminal 201 is shown with substantially the same width as the interior area of the receptacle section 18 (but slightly smaller), such as a 1.2 mm blade width for example. When the pin contact section 200 is inserted into the receptacle section 18 the contact areas 86 make contact with one side of the section 200. The projection 84 is located opposite the center section 44 of the spring 16. Therefore, the spring biases the section 200 towards the projection 84. As seen with reference to FIG. 13, in this embodiment the top contact areas 86 are rounded. Thus, contact with the section 200 is more concentrated due to the patterned shape and the limited cross sectional size of the areas 86. As seen by the dotted lines 87 in FIG. 12, the blade 201 makes contact with the areas 86 at a limited reduced area of the bottom side of the receptacle section. This provides greater wiping action of the blade terminal as it is inserted and greater contact force at the areas 86.

Figure 14:
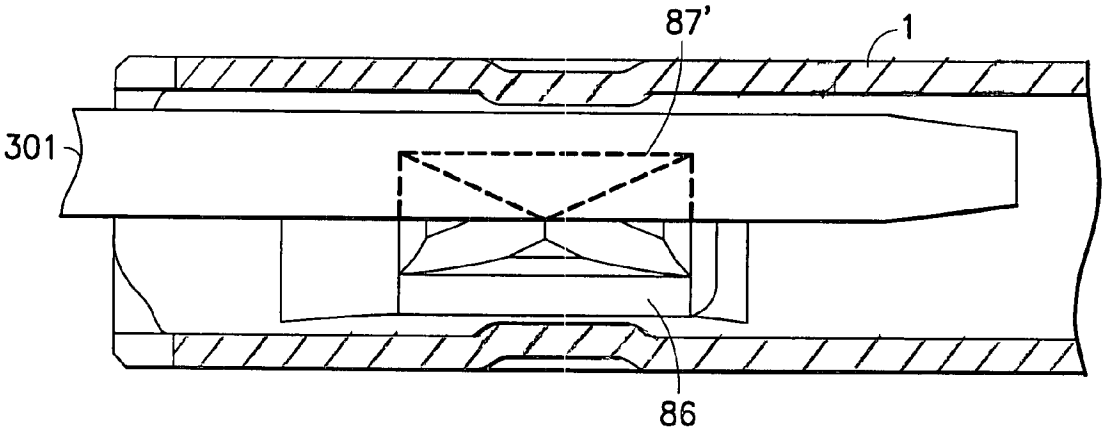
FIG. 14 is a cross sectional view as in FIG. 12 showing insertion of another type of male or blade terminal at an offset location.
Figure 15:
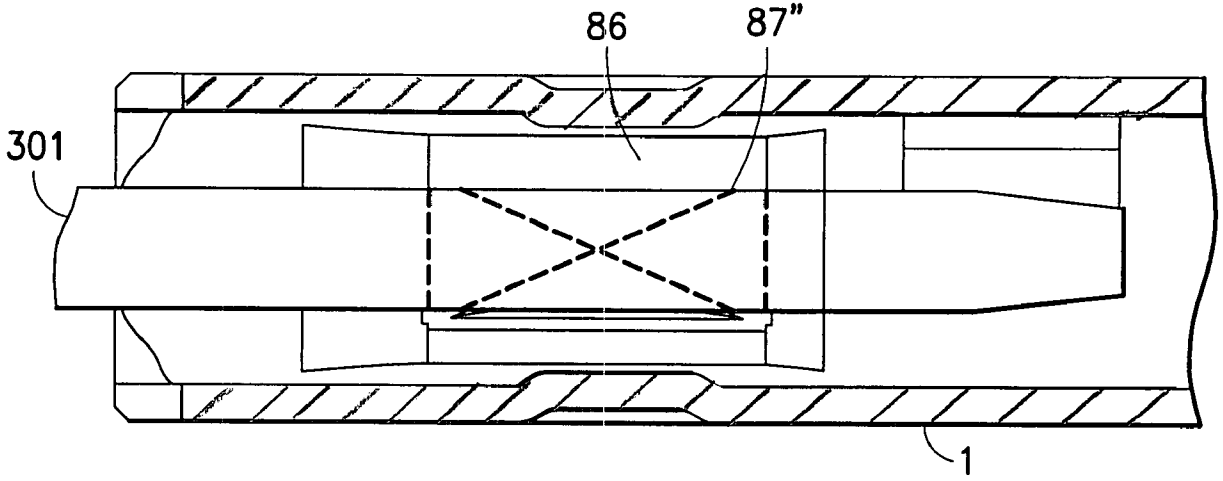
FIG. 15 is a cross sectional view as in FIG. 14 showing insertion of the male blade terminal at a centered location.
Figure 16:
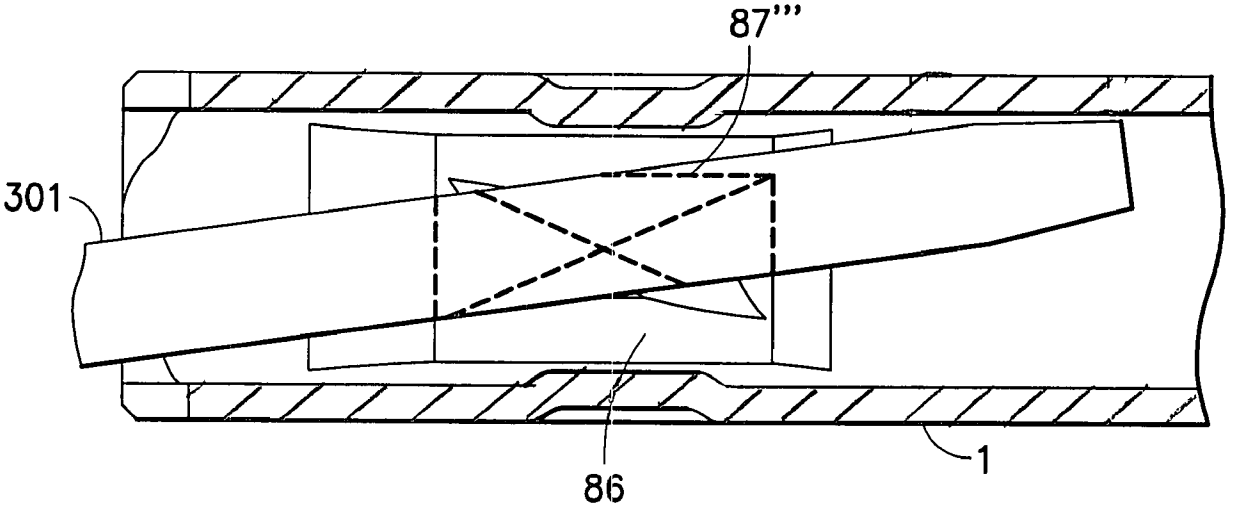
FIG. 16 is a cross sectional view as in FIG. 14 showing insertion of the male blade terminal at an angled location.

Referring also to FIGS. 14-16, the patterned shape of the inward projection 84 and the radius-on-flat surface contact between the areas 86 and the blade terminal can allow the receptacle terminal 1 to be used with smaller width male contacts. In the example shown in FIGS. 14-16, the receptacle terminal 1 is designed for use with a 1.2 mm width male blade terminal 201, but can be used with a substantially smaller 0.64 mm width male blade terminal 301. For example, FIG. 14 shows the terminal 301 inserted into the receptacle terminal 1 offset entirely to one side and making contact with areas 86 as indicated by dotted line 87'. About 50 percent of the areas 86 are still contacted. FIG. 15 shows the terminal 301 inserted into the receptacle terminal 1 at a centered position and making contact with areas 86 as indicated by dotted line 87". FIG. 16 shows the terminal 301 inserted into the receptacle terminal 1 at an angled or canted position and making contact with areas 86 as indicated by dotted line 87'''. The male blade 30 still contacts about 50 percent of the areas 86. Thus, the radius-on-flat contact between the terminals at areas 86 is maintained for a variety of blade widths and angles.

The shape of the fixed side 22 provides a stable and reliable contact geometry (with radius-on-flat contact) regardless of the blade width or blade entry angle. No secondary lead-in ramp on the bottom side is necessary because of the shape of the inward projection 84. The projection 84 provides this lead-in feature.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. A multi-piece electrical receptacle terminal comprising;

a frame with a receptacle section adapted to receive a male contact; and a spring movably captured in the receptacle section, wherein the spring comprises a front end and a contact section spaced from the front end for contacting the male contact when the male contact is inserted into the receptacle section, wherein the frame comprises inward projections capturing the front end of the spring at the inward projections, wherein the inward projections comprise a first inward projection located directly in front of the front end of the spring and a second inward projection located directly behind the front end of the spring, wherein the receptacle section comprises an interior facing frame contact surface for contacting the male contact when the male contact is inserted into the receptacle section, and wherein the frame contact surface comprises at least one inward projection which form a plurality of angled contact areas which are angled relative to each other along their length, wherein at least one of the contact areas is angled relative to an insertion path of the male contact into the receptacle section.

2. A multi-piece electrical receptacle terminal as in claim 1 wherein the inward projections comprise a first inward projection from a top side of the frame at a male contact entrance at a front end of the frame.

3. A multi-piece electrical receptacle terminal as in claim 2 wherein the inward projections comprise a second inward projection from a lateral side of the frame.

4. A multi-piece electrical receptacle terminal as in claim 1 wherein the inward projections comprise lateral side projections extending inward at the receptacle section from opposite lateral sides of the frame.

5. A multi-piece electrical receptacle terminal as in claim 1 wherein a middle section of the spring comprises lateral sides extending into limiting holes in lateral sides of the frame at the receptacle section.

6. A multi-piece electrical receptacle terminal as in claim 1 wherein the front end of the spring comprises two laterally outward projections.

7. A multi-piece electrical receptacle terminal as in claim 1 wherein the front end of the spring comprises a top surface at outer lateral edges in contact with a bottom surface of a top side of the receptacle section proximate interior corners of the top side of the receptacle section.

8. A multi-piece electrical receptacle terminal as in claim 7 wherein a rear end of the spring comprises outer lateral edges in contact with the top side of the receptacle section proximate the interior corners of the top side of the receptacle section.

9. A multi-piece electrical receptacle terminal as in claim 7 wherein the front end of the spring comprise a general T shape.

10. A multi-piece electrical receptacle terminal as in claim 1 wherein the at least one inward projection comprises a patterned surface.

11. A multi-piece electrical receptacle terminal as in claim 10 wherein the patterned surface comprises a general X shaped pattern.

12. A multi-piece electrical receptacle terminal as in claim 11 wherein the patterned surface comprises a general box shaped pattern.

13. A multi-piece electrical receptacle terminal comprising:

a frame with a receptacle section adapted to receive a male contact; and a spring movably located in the receptacle section, wherein the spring comprises a front end with two laterally outward projections, and a contact section for contacting the male contact when the male contact is inserted into the receptacle section, wherein the frame captures the two laterally outward projections of the front end of the spring at a front end of the frame between at least one first inward projection located directly in front of the outward projections and at least one second inward projection located directly behind the outward projections, wherein the receptacle section comprises an interior facing frame contact surface for contacting the male contact when the male contact is inserted into the receptacle section, and wherein the frame contact surface comprises at least one inward projection which form a plurality of angled contact areas which are angled relative to each other along their length, wherein at least one of the contact areas is angled relative to an insertion path of the male contact into the receptacle section.

14. A multi-piece electrical receptacle terminal as in claim 13 wherein a middle section of the spring comprises lateral sides extending into limiting holes in lateral sides of the frame at the receptacle section.

15. A multi-piece electrical receptacle terminal as in claim 13 wherein the front end of the spring comprises a top surface of outer lateral edges in contact with a bottom surface of a top side of the receptacle section proximate interior corners of the top side of the receptacle section.

16. A multi-piece electrical receptacle terminal as in claim 15 wherein the front end of the spring comprise a general T shape.

17. A multi-piece electrical receptacle terminal as in claim 13 wherein the at least one inward projection comprises a patterned surface.

18. A multi-piece electrical receptacle terminal as in claim 17 wherein the patterned surface comprises a general X shaped pattern.

19. A multi-piece electrical receptacle terminal as in claim 18 wherein the patterned surface comprises a general box shaped pattern.

20. A multi-piece electrical receptacle terminal comprising:

a frame with a receptacle section adapted to receive a male contact, wherein the receptacle section comprises an interior facing frame contact surface for contacting the male contact when the male contact is inserted into the receptacle section, and wherein the frame contact surface comprises at least one inward projection which form a plurality of angled contact areas which are angled relative to each other along their lengths, wherein at least one of the contact areas is angled relative to an insertion path of the male contact into the receptacle section; and a spring movably captured in the receptacle section, wherein the spring comprises a spring contact surface for contacting the male contact when the male contact is inserted into the receptacle section, wherein the spring contact surface is located opposite the frame contact surface.

21. A multi-piece electrical receptacle terminal as in claim 20 wherein the at least one inward projection comprises a patterned surface.

22. A multi-piece electrical receptacle terminal as in claim 21 wherein the patterned surface comprises a general X shaped pattern.

23. A multi-piece electrical receptacle terminal as in claim 21 wherein the patterned surface comprises a general box shaped pattern.

24. A multi-piece electrical receptacle terminal comprising:

a frame with a receptacle section adapted to receive a male contact, wherein the receptacle section comprises a frame contact surface at an interior side of the frame for contacting the male contact when the male contact is inserted into the receptacle section, and wherein the frame contact surface comprises at least one inward projection which forms a plurality of contact areas, wherein at least two of the contact areas extend across a majority of a width of the receptacle section and are spaced relative to each along an insertion path of the male contact into the receptacle section, wherein at least one of the contact areas is angled relative to the insertion path of the male contact into the receptacle section; and a spring movably captured in the receptacle section, wherein the spring comprises a spring contact surface for contacting the male contact when the male contact is inserted into the receptacle section, wherein the spring contact surface is located opposite the frame contact surface.

25. A multi-piece electrical receptacle terminal as in claim 24 wherein the at least two contact areas each have an elongate length which extends generally transverse to the insertion path of the male contact into the receptacle section.

* * * * *